US007857306B2

(12) United States Patent
Enomoto

(10) Patent No.: US 7,857,306 B2
(45) Date of Patent: Dec. 28, 2010

(54) MEDIUM STACKER APPARATUS

(75) Inventor: Hideki Enomoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 397 days.

(21) Appl. No.: 10/862,873

(22) Filed: Jun. 8, 2004

(65) Prior Publication Data

US 2005/0012260 A1 Jan. 20, 2005

(30) Foreign Application Priority Data

Jun. 10, 2003 (JP) ..... 2003-165501

(51) Int. Cl.
*B65H 31/04* (2006.01)

(52) U.S. Cl. ..... 271/213; 271/220

(58) Field of Classification Search ..... 271/207, 271/220, 145, 162, 163, 213; 347/104
See application file for complete search history.

(56) References Cited

U.S. PATENT DOCUMENTS

| | | | | |
|---|---|---|---|---|
| 5,156,390 | A * | 10/1992 | Nagao et al. | 271/202 |
| 5,234,212 | A * | 8/1993 | Dutra, Jr. | 271/207 |
| 5,241,353 | A * | 8/1993 | Maeshima et al. | 399/405 |
| 5,308,058 | A * | 5/1994 | Mandel et al. | 271/289 |
| 5,464,205 | A * | 11/1995 | Bang | 271/213 |
| 5,586,758 | A * | 12/1996 | Kimura et al. | 271/303 |
| 6,070,868 | A | 6/2000 | Nagato et al. | |
| 6,601,842 | B2 * | 8/2003 | Kobayashi et al. | 271/3.14 |
| 6,810,231 | B2 * | 10/2004 | Kobayashi et al. | 399/367 |
| 7,079,806 | B2 * | 7/2006 | Baek et al. | 399/405 |
| 7,121,543 | B2 * | 10/2006 | Fujioka | 271/207 |
| 2002/0180137 | A1 * | 12/2002 | Kobayashi et al. | 271/3.14 |
| 2006/0071393 | A1 * | 4/2006 | Mizubata et al. | 271/10.01 |

FOREIGN PATENT DOCUMENTS

| | | |
|---|---|---|
| JP | 05-278868 | 10/1993 |
| JP | 07-315670 | 12/1995 |

OTHER PUBLICATIONS

EP 04253399.2-2314-, Aug. 8, 2004, Foreign Office Action.

* cited by examiner

*Primary Examiner*—Stefanos Karmis
*Assistant Examiner*—Michael C McCullough
(74) *Attorney, Agent, or Firm*—Rabin & Berdo, PC

(57) ABSTRACT

A medium stacker apparatus comprising a stacking portion for stacking a medium discharged from a delivery section formed at an upper portion of an apparatus housing, has a top cover which can be open and closed with respect to the apparatus housing, and a part of said stacking portion is formed at the top cover. The stacking portion is constituted of a first stacking portion formed as secured to the apparatus housing, and a second stacking portion serving as a part of the top cover and pivoting openably as separately from the first stacking portion. Printing media therefore do not interfere with the delivery section in a case where the top cover as the second stacking portion is made to be pivotally moved as opened while the printing media are stacked on the stacking portion.

6 Claims, 15 Drawing Sheets

FIG. 12 PRIOR ART

MEDIUM STACKER APPARATUS

BACKGROUND OF THE INVENTION

1. Field of the Invention

This invention relates to a medium stacker apparatus for stacking discharged media and, more particularly, to a medium stacker apparatus incorporated in, e.g., a page printer.

2. Description of Related Art

Conventionally, some printing apparatus or the like have a structure for stacking delivered media on a top of the top cover to make the apparatus compact. With these apparatuses, the top cover is provided pivotally movably, and therefore the apparatus interior is easily accessible by opening the top cover by ninety degrees or more in the case where obstruction such as printing medium jamming during printing occurs or where consumable parts are to be replaced.

FIG. 12 is an external view showing a conventional printing apparatus, and FIG. 13 is a schematic side view showing an inside of the conventional printing apparatus. As shown in FIG. 12 and FIG.13, a top cover 2 is formed at a printing apparatus housing, and the top cover is in a pivotally movable state around a pivotal center 3 as the center. A stacking portion 4 for stacking printed printing media, is formed at the top cover 2, and a distal end 5 of the stacking portion 4 is formed as projected in a substantially vertical direction so as to prevent the printing media from falling inside the apparatus 1. A cutout portion 6 is formed at the distal end 5, and an ejection roller 7 is arranged at the cutout portion 6. The ejection roller 7 is revolvably formed on the apparatus housing 1. A pressure roller 8 is formed at the top cover 2 as facing to the ejection roller 7.

An exposure head 9 is formed below the top cover 2 and is located at a prescribed position on an image formation unit 10 in a state that the top cover 2 is closed as shown in FIG. 12. A position of the exposure head 9 is set as substantially the same in a horizontal direction as a position of the pivotal center 3 of the top cover 2. This is for positioning accurately the exposure head 9 because the position of the exposure head 9 is set by closing the top cover 2. A fixing unit 11 is arranged below the stacking portion 4 of the top cover 2.

The ejection roller 7 and the pressure roller 8 discharge and stack the printed media on the stacking portion 4 of the top cover 2. With the apparatus shown in FIG. 12 and FIG. 13, the top cover 2 is made opened after the printing media thereon are removed where the top cover 2 is to be opened while the printing media are stacked. This is because the printing media may drop and be scattered where the top cover 2 is intended to be opened without removing the printing media.

To prevent the above, that is, to prevent the printing media on the top cover from falling in where the top cover is opened, a paper delivery apparatus having a member holding printing media when the top cover is opened has been invented, and the apparatus is as disclosed in, e.g., Japanese Patent Application Publication No. JA-7-315,670.

Disclosed in the above Publication is that a paper holding member is pivotally formed at an upper cover, that the paper holding member is positioned as separated from the upper cover when the upper cover is closed, and that the member presses a paper receiving table for stacking papers when the upper cover is opened.

With this conventional apparatus described above, however, the distal end 5 of the stacking portion 4 as shown in FIG. 12 needs to be deeply formed in a case where a large number of the printing media are stacked on the stacking portion 4 of the top cover. However, if the distal end 5 of the stacking portion 4 is deeply formed, the distal end 5 hits the shaft of the ejection roller 7. Accordingly, there raises a problem that the distal end 5 of the stacking portion 4 cannot be deeply formed. This problem will be briefly explained with referring to FIG. 14 and FIG. 15.

FIG. 14 is an operation illustration in a case where an end 4*b* of the stacking portion is comparatively shallowly formed, and FIG. 15 is an operation illustration in a case where the end 4*b* is deeply formed. In FIG. 14, a stacking portion 4*a* of the top cover and a medium stopping portion 5*a* are pivotally moved in a direction of an arrow around a pivotal center 3 as a center. In this situation, as showed by a dotted line, the medium stopping portion 5*a* can pass over a shaft 11 of an ejection roller 7, so that the top cover is movable up to a predetermined position with the medium stopping portion 5*a* not in contact with the shaft 11. To the contrary, in FIG. 15, where the medium stopping portion 5*a* is deeply formed, the medium stopping portion 5*a* interferes with the shaft 11 of the ejection roller 7 as showed a dotted line, so that the top cover is not pivotally movable up to the predetermined position. As described above, it is difficult to form the end 4*b* of the stacking portion 4*a* deeply, so that media of a certain amount or more cannot be stacked.

SUMMARY OF THE INVENTION

To solve the above problems, this invention is characterized in that a medium stacker apparatus is provided with a stacking portion stacking media discharged from an outlet formed at an upper portion of an apparatus housing and that said stacking portion comprises a first stacking portion formed as secured to the apparatus housing, and a second stacking portion formed as pivotally movable separately from said first stacking portion.

With the structure described above, where the second stacking portion is pivotally moved while the media are stacked on the stacking portion, the media enter in a standing state. In this situation, the first stacking portion is formed at the apparatus housing and thereby not pivotally moved, and because the first stacking portion does not conflict with a part of an outlet for discharging the media and because a distance between an end of the second stacking portion and the outlet is kept as a predetermined distance, the second stacking portion can be pivotally movable even where the media in a large number are stacked.

In addition to the above described structure, a pivoting portion may be formed, which is formed in a pivotally movable state at the second stacking portion as arranged between the first stacking portion and the second stacking portion. With the apparatus thus structured, a larger space on a side of the apparatus housing can be advantageously utilized where the second stacking portion is pivotally moved.

DETAILED DESCRIPTION OF PREFERRED EMBODIMENTS OF THE INVENTION

Figure 1:
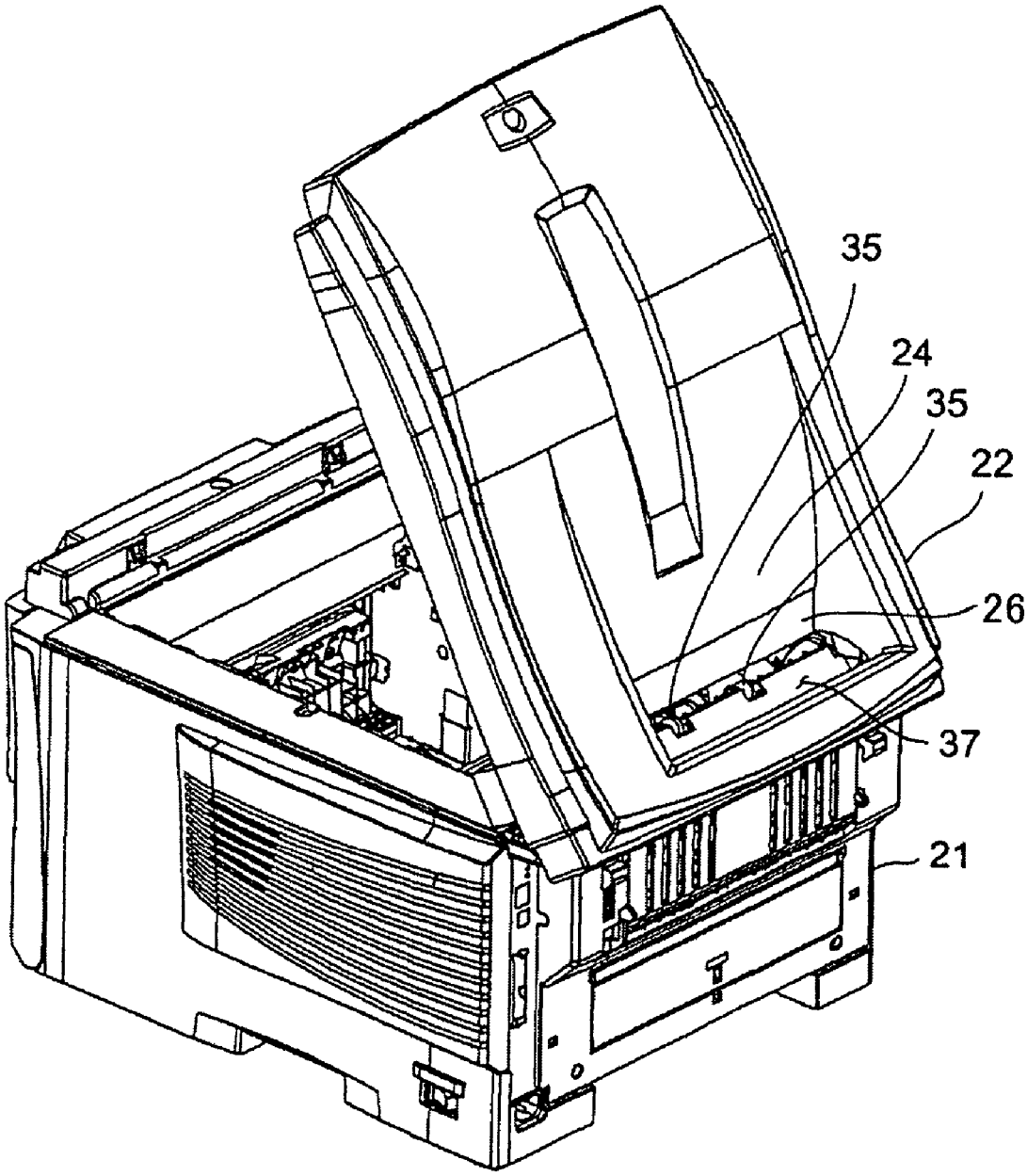
FIG. 1 is an external view showing a medium stacker apparatus according to the first embodiment of the invention.
Figure 2:
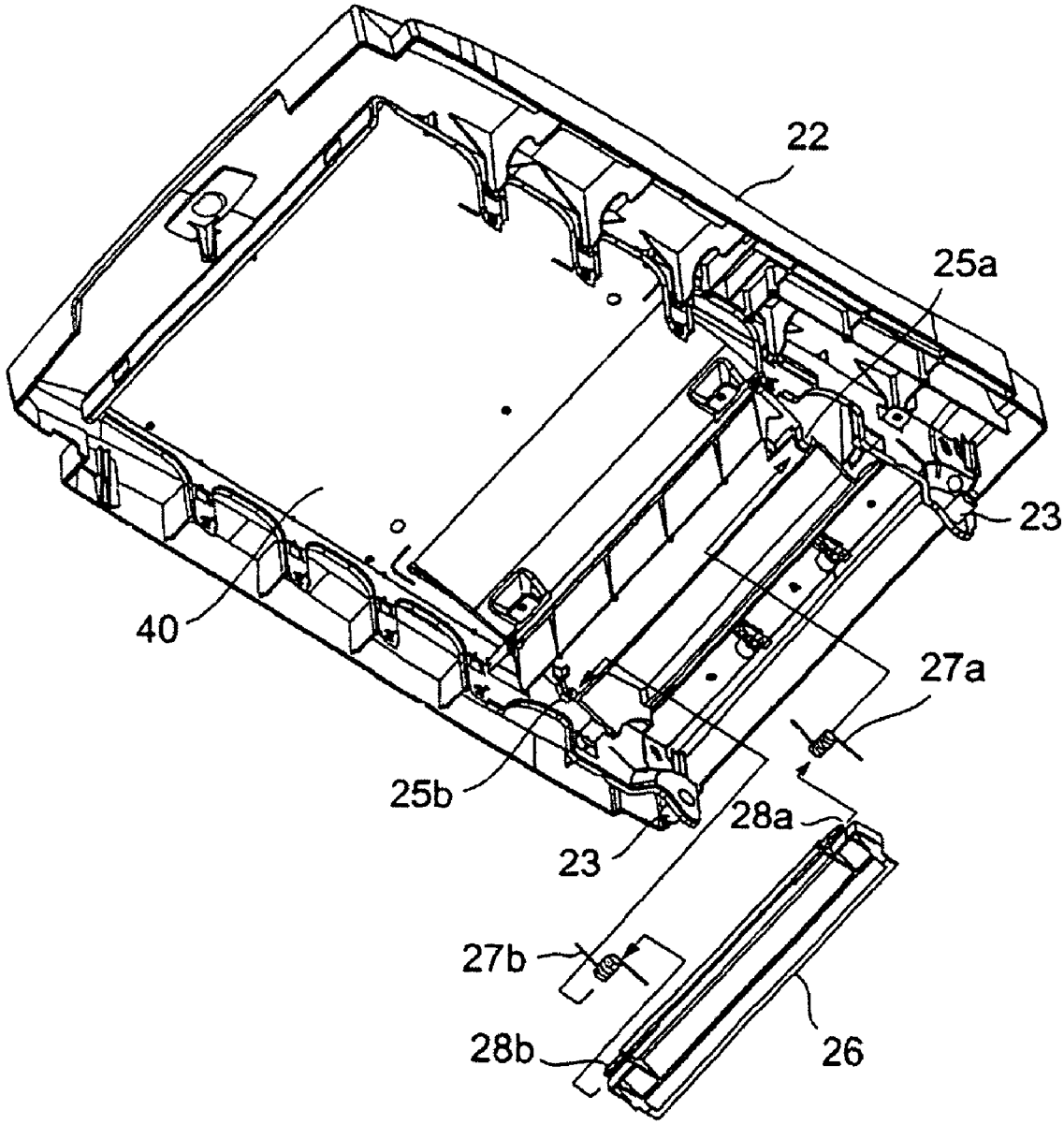
FIG. 2 is an exploded perspective view showing a back surface of a top cover according to the first embodiment.
Figure 3:
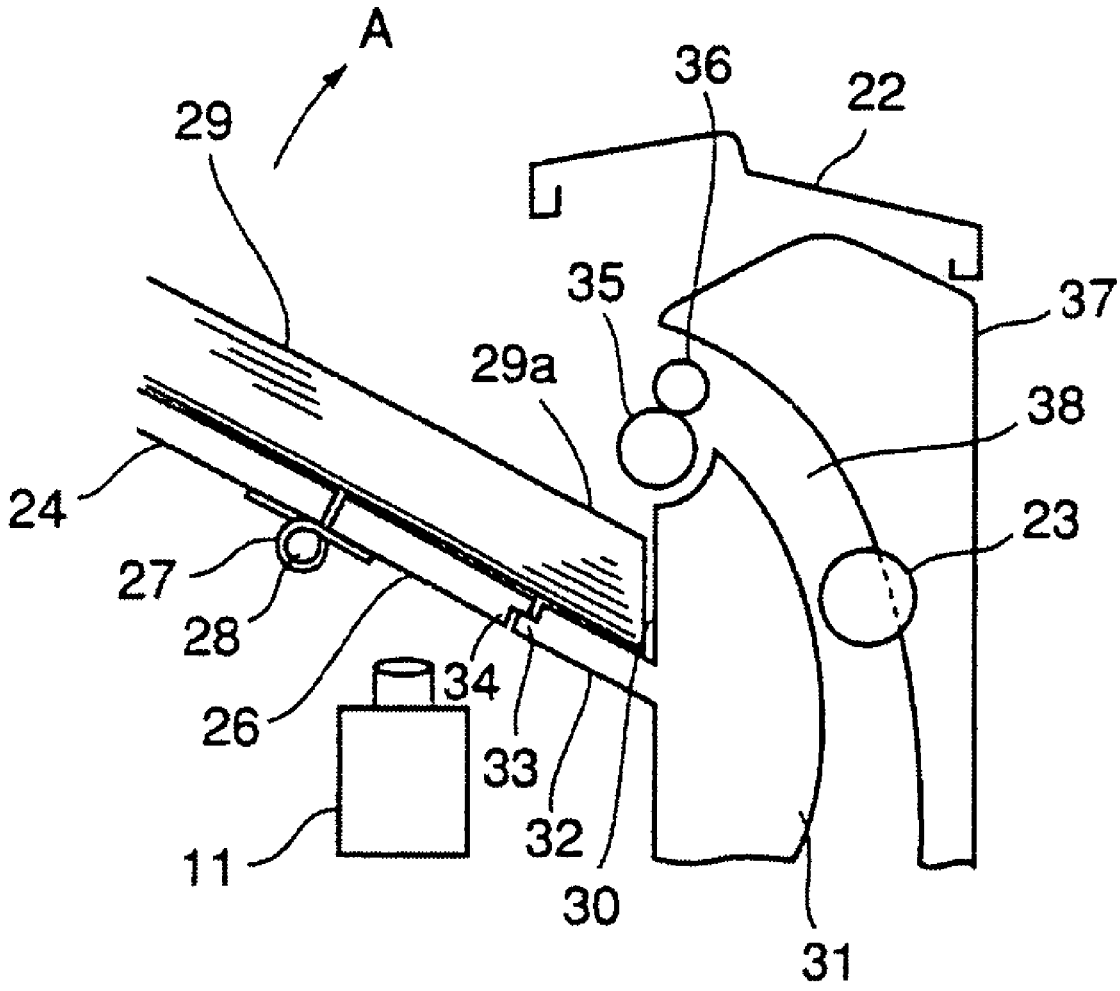
FIG. 3 is a schematic side view showing an essential part according to the first embodiment.

Hereinafter, embodiments according to this invention will be described with reference to the drawings. In addition, the same numeral is assigned to an element common to respective figures. FIG. 1 is an external view showing a medium stacker apparatus according to the first embodiment of this invention; FIG. 2 is an exploded perspective view showing a back surface of a top cover according to the first embodiment; FIG. 3 is a schematic side view showing an essential part according to the first embodiment. In the embodiments herein, exemplified are a printing medium delivery mechanism incorporated in a printer as a medium stacker apparatus.

In FIG. 1, FIG. 2, and FIG. 3, a top cover 22 is formed at a printing apparatus housing 21 as pivotally movable around a post 23 as a center. The top cover 22 is made of a synthetic resin such as, e. g., an engineering plastic and has a stacking portion 24 for stacking printing media that have already printed. As shown in FIG. 2, bearing portions 25*a*, 25*b* are formed below the top cover 22, and a pivoting member 26 is attached through torsion springs 27 (27*a* and 27*b*) to the bearing portions 25*a*, 25*b*. The pivoting member 26 is pivotally moved as being in contact with the printing media where the top cover is opened while the printing media are stacked thereon. More specifically, the torsion springs 27*a*, 27*b* are fitted in the posts 28*a*, 28*b* formed respectively at opposite ends of the pivoting member 26, and these posts 28*a*, 28*b* are fitted in the bearing portions 25*a* and 25*b*.

The torsion springs 27 urge the pivoting member 26 in the counterclockwise direction in FIG. 3, and the pivoting member 26 is pivotally movable in the clockwise direction in opposing to the urging force of the torsion springs 27. The pivoting member 26 is urged by the torsion springs 27 but is stopped at a position forming the same flat surface as the surface of the stacking portion 24 as shown in FIG. 3 by means of a stopper not shown. The pivoting member 26 is formed extending longer in a width direction than the maximum width of printing media handled in this apparatus.

In FIG. 3, the stacking portion 24, as different from the conventional apparatus, is separated from a distal end 30 on which a rear end 29*a* of the printing media 29 is stacked. The distal end 30 forms a part of an ejection guide 31, and the ejection guide 31 is attached to the apparatus housing 21. The ejection guide 31 has an end stacking portion 32 forming the same flat surface as the stacking portion 24. An engagement portion 33 is formed at the end stacking portion 32 and engages an engagement portion 34 of the pivoting member 26, so that the stacking portion 24, the pivoting member 26, and the end stacking portion 32 form the same flat surface. Where the engagement portion 34 of the pivoting member 26 engages the engagement portion 33 of the end stacking portion 32, the pivoting member 26 is prevented from pivotally moving in the clockwise direction.

Each of the ejection roller 35 and the pressure roller 36 is revolvably formed at the ejection guide 31, and a gear series, not show, for rotationally driving the ejection roller 35 is mounted on the ejection guide 31. The ejection roller 35 and the pressure roller 36 constitute a delivery section, and the delivery section is disposed on a side of a pivotal center (post) 23 of the top cover 22 with respect to the stacking portion 24 of the top cover 22. A rear cover 37 is formed in facing to the ejection guide 31, and the ejection guide 31 and the rear cover 37 form a feeding passage 38 for the printing medium 29. The post 23 as the pivotal center of the top cover 22 is formed near the feeding passage 38. A fixing unit 11 is arranged below the pivoting member 26.

In FIG. 2, the top cover 22 is combined with an inner plate 40 made of a metal plate secured by several screws, thereby ensuring the strength of the top cover. The post 23 is arranged at each side of the inner plate 40. Torsion springs, not shown, are built into the posts 23, thereby lifting up the top cover 22 when a locked state of the top cover 22, which is locked as being closed, is released, and further reducing, when the top cover 22 is closed, the falling speed so that the top cover 22 does not fall rapidly.

Figure 4:
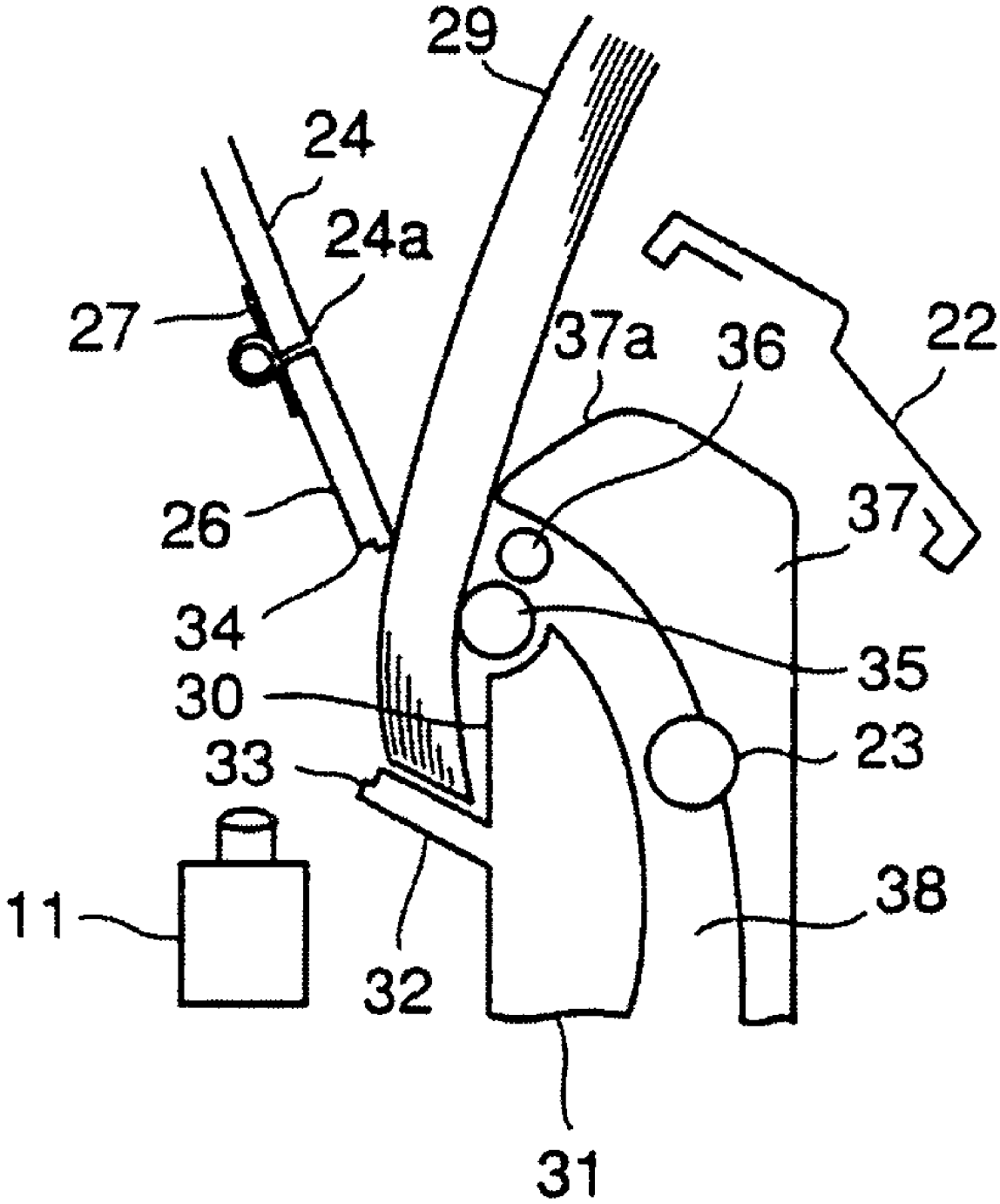
FIG. 4 is an operation illustration of the first embodiment.
Figure 5:
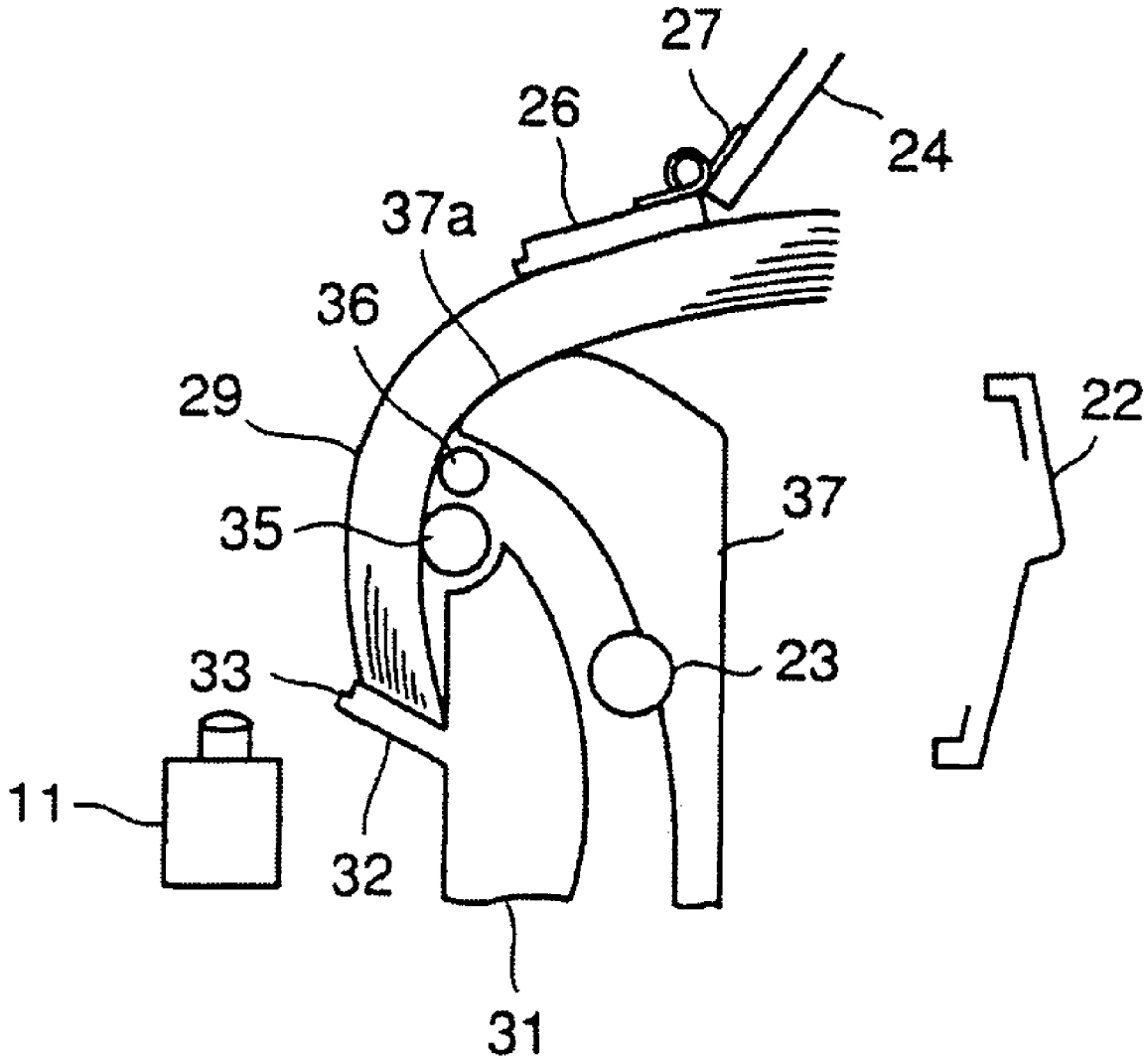
FIG. 5 is an operation illustration of the first embodiment.

Next, operation of the first embodiment is described with further referring to operation illustrations, FIG. 4 and FIG. 5. Herein, operation of opening the top cover is described. FIG. 3 shows a state that the top cover 22 is closed and that the printing media 29 are stacked on the stacking portion 24 of the top cover 22, the pivoting member 26, and the end stacking portion 32. From this state, the top cover 22 is pivotally moved in the direction of arrow A shown in FIG. 3.

Where the top cover 22 begins pivotal movement around the posts 23 as the center, the engagement portion 34 of the pivoting member 26 separates from the engagement portion 33 of the end stacking portion 32, and the stacking portion 24 and the pivoting member 26 move pivotally around the posts 23 as a center. The printing media 29 are lifted up according to the pivotal movement of the stacking portion 24, but a front end 29*a* of the printing media 29 remains as located on the end stacking portion 32. The pivoting member 26 pivotally moves as being in contact with the printing media 29, and the printing media 29 contacts with the ejection roller 35 and further contacts with an upper end 37*a* of the rear cover 37.

Where the top cover 22 is opened with an angle of a maximum degree, the pivoting member 26 is in contact with the printing media, so that the printing media are pivotally moved as to escape from a medium stacking surface. Consequently, a problem that the top cover 22 is not further open due to jamming of the printing media between the top cover 22 and the rear cover 37, can be solved. In other words, the printing member 26 advantageously operates not to disturb the opening motion of the top cover 22 otherwise possibly disturbing the opening motion due to stacking of the printing media. Because the pivoting member 26 is urged by the torsion springs 27, the printing media 29 are nipped between the pivoting member 26 and the upper end 37*a* of the rear cover 37 as shown in FIG. 5. At this point, the pivoting member 26 is pivotally moving in the clockwise direction with respect to the stacking portion 24 and made open, and the member presses the printing media 29 with this state. As shown in FIG. 5, the pivoting member 26 opens with a wider angle as the number of the printing media 29 is larger or as the top cover 22 opens with a wider angle. Consequently, pressing force for pressing the printing media 29 becomes larger.

Because the pivoting member 26 presses the standing printing media 29, the printing media 29 cannot be unbundled and are kept in a stable state.

If a distance between a trace drawn by movement of an end 24*a* of the stacking portion 24 and the ejection roller 35 or a distance between a trace drawn by movement of the end 24*a* of the stacking portion 24 and the upper end 37*a* of the rear cover 37 is wider when the top cover 22 is open, the top cover 22 can be opened and closed where the printed media 29 of many number of sheets according to that width are stacked. The end 30 formed at the ejection guide 31 is formed on the side of the apparatus housing 21, thereby being easily formed deeply to stack the printing media 29 more. The printing media 29 in a larger member, therefore, can be stacked in comparison with the conventional apparatus.

In the first embodiment, where the top cover 22 is opened, the pivoting member 26 is separated from the end stacking portion 32 on the side of the apparatus housing 21. Therefore, where the top cover 22 is opened as shown in FIG. 5, a lower space of the position of the pivoting member 26 located when the top cover 22 is closed can be released. With the apparatus illustrated in this embodiment, the fixing unit 11 is disposed at the lower space, so that the fixing unit 11 or the like can be easily replaced.

In the first embodiment thus described, because of formation of the pivotally movable pivoting member 26, the printing media 29 in a large number can be stacked, and a further wider range in a direction closer to the pivotal center can be released. Because the end 30 located below the ejection roller 35 is formed on the side of the apparatus housing 21, no cutout is necessarily formed at this end 30, so that the appearance as an apparatus is greatly improved. The printing media 29 can be stably held as the top cover 22 is opened.

Figure 6:
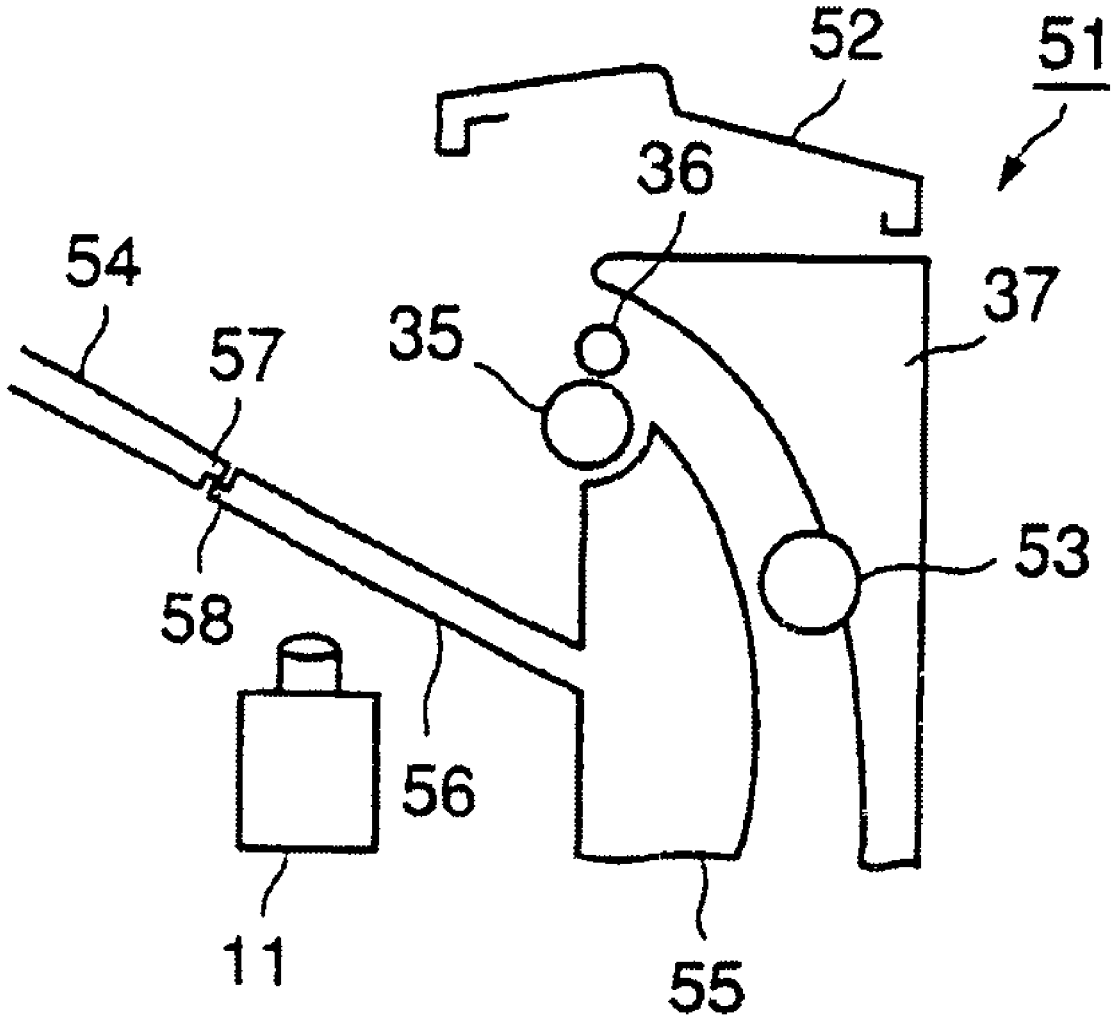
FIG. 6 is a schematic side view showing an essential part according to the second embodiment.

Next, the second embodiment will be described. FIG. 6 is a schematic side view showing an essential part according to the second embodiment. In FIG. 6, with a printing apparatus housing 51 according to the second embodiment, similarly to the first embodiment, a top cover 52 is provided as pivotally movable around a post 53 as a pivotal center, and a stacking portion 54 is formed at a top cover 52. An ejection guide 55 is formed on the side of the apparatus housing 51, and an end stacking portion 56 is formed at the ejection guide 55.

An engagement portion 57 of the stacking portion 54 engages an engagement portion 58 of the end stacking portion 56 while the top cover 52 is closed, and this engagement brings the stacking portion 54 and the end stacking portion 56 to be on the same flat surface. The end stacking portion 56 is formed longer than the end stacking portion 32 in the first embodiment. This design allows the apparatus to take a wider interval between a trace drawn by movement of the engagement portion 57 of the stacking portion 54 and the ejection roller 35 or the rear cover 37 when the top cover 52 is made open and closed.

Figure 7:
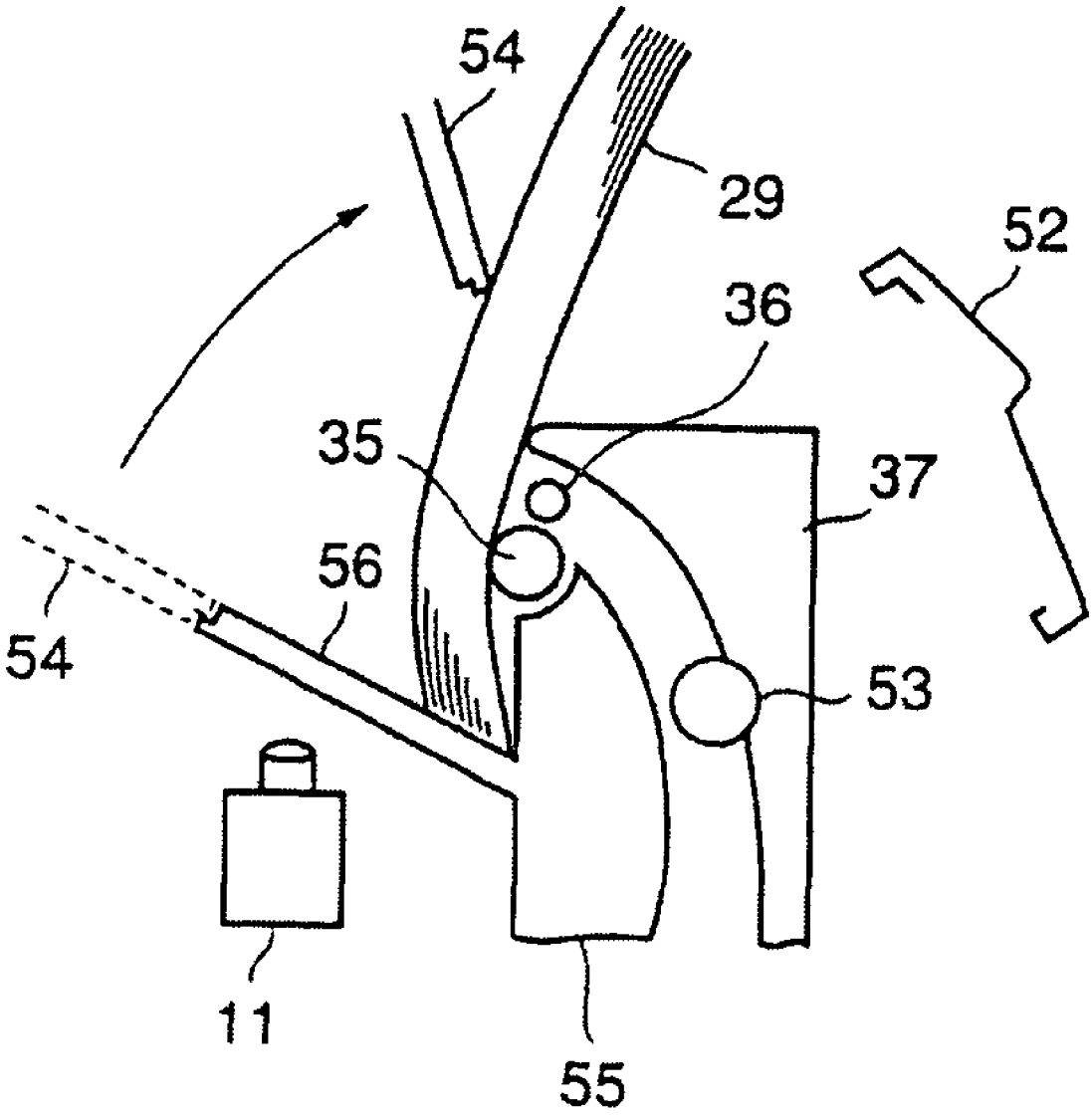
FIG. 7 is an operation illustration showing operation of the second embodiment.

FIG. 7 is an operation illustration showing operation of the second embodiment. In FIG. 7, where the top cover 52 is made open as the printing media 29 are stacked thereon, the stacking portion 54 separates from the end stacking portion 56 and pivotally moves around the posts 53 as the center. The interval between the engagement portion 57 of the stacking portion 54 and the ejection roller 35 or the rear cover 37 is taken as wider, so that the top cover 52 can be open and closed even where the printing media of many number of sheets according to that interval are stacked.

In the second embodiment, the end stacking portion 56 is formed comparatively long, so that the lower space of the end stacking portion 56 is not released even where the top cover 52 is made open, and therefore, the fixing unit 11 located below the end stacking portion 56 is not easily accessible. The second embodiment, however, has an advantage, with such a simpler structure in comparison with the first embodiment, to make the top cover openable as the printing media of a large number are stacked.

Figure 8:
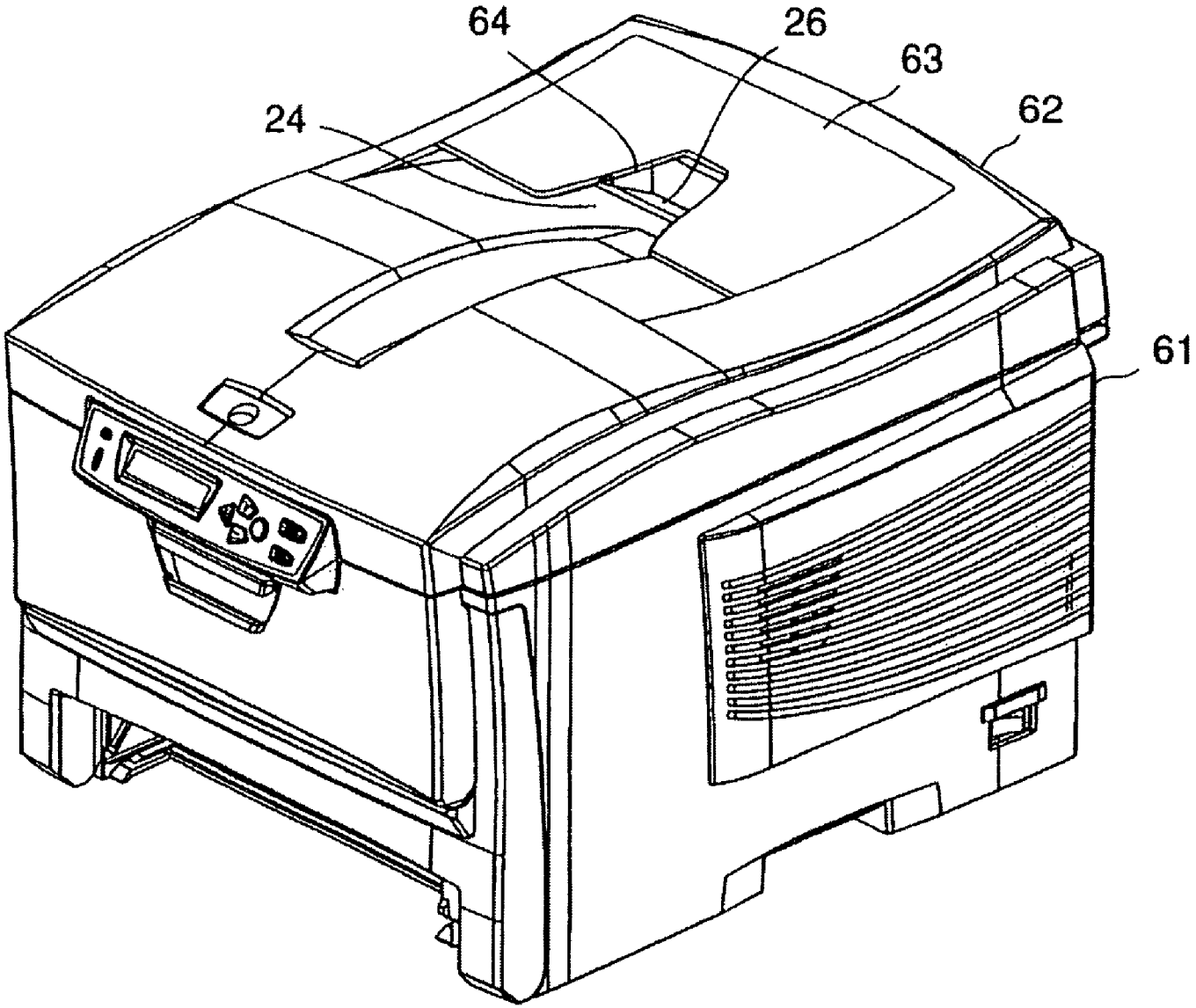
FIG. 8 is an external view showing a medium stacker apparatus according to the third embodiment.

Next, the third embodiment will be described. FIG. 8 is an external view showing a medium stacker apparatus according to the third embodiment. In the third embodiment, a medium receiving member is formed on the top cover as compared with the apparatus according to the first embodiment.

In FIG. 8, a top cover 62 is openably provided on an apparatus housing 61 of the third embodiment, and a medium receiving portion 63 is formed on the upper portion of the top cover 62 as a united body. The media receiving portion 63 is arranged at an upper portion of a delivery section discharging the printing media, namely, a part of the stacking portion 24, the pivoting member 26, and the ejection roller 35. A cutout portion 64 in substantially a letter-V shape is formed at the medium receiving portion 63 at a center portion on the distal end side. The other structures are substantially the same as the first embodiment.

Figure 9:
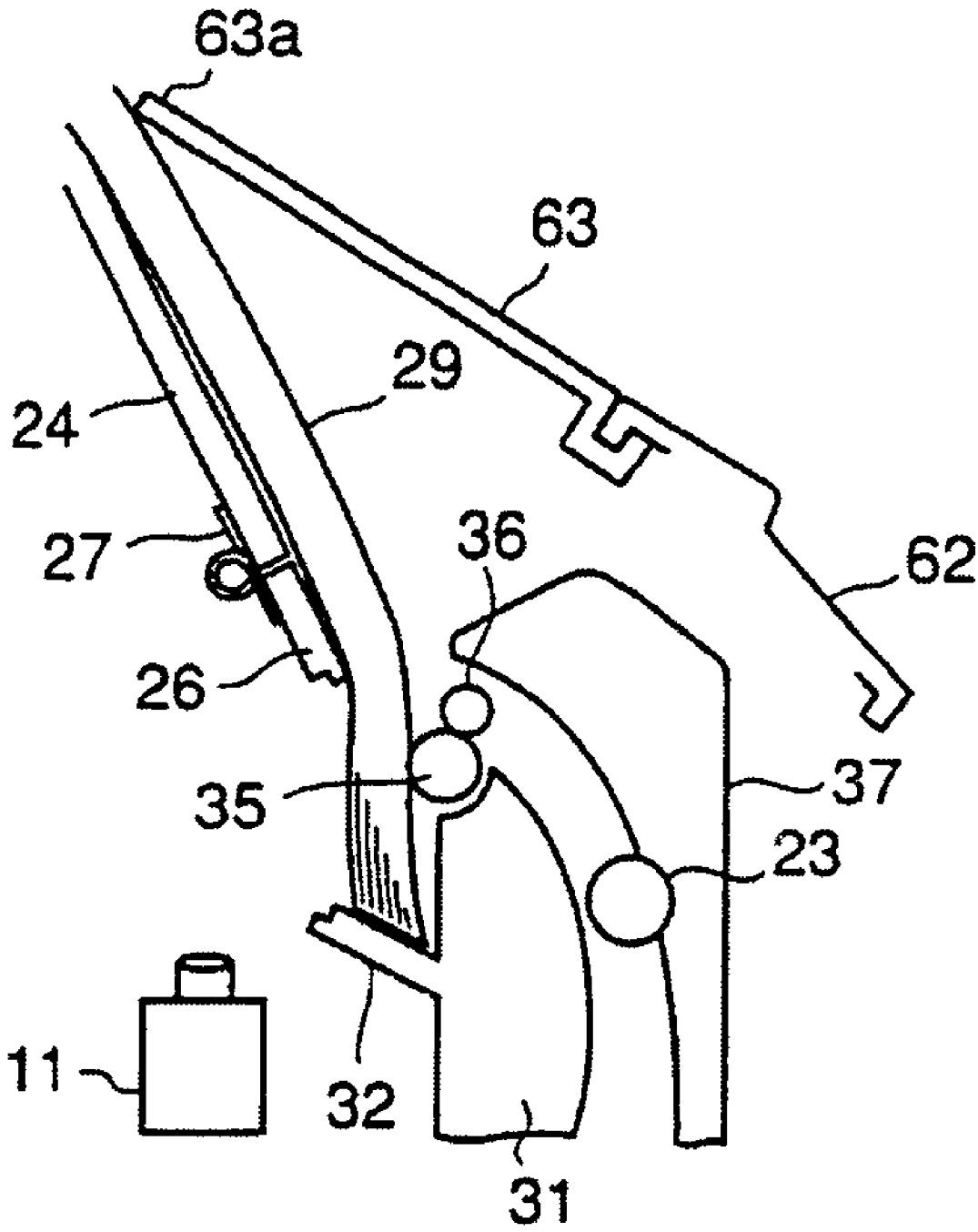
FIG. 9 is an operation illustration showing operation of the third embodiment.
Figure 10:
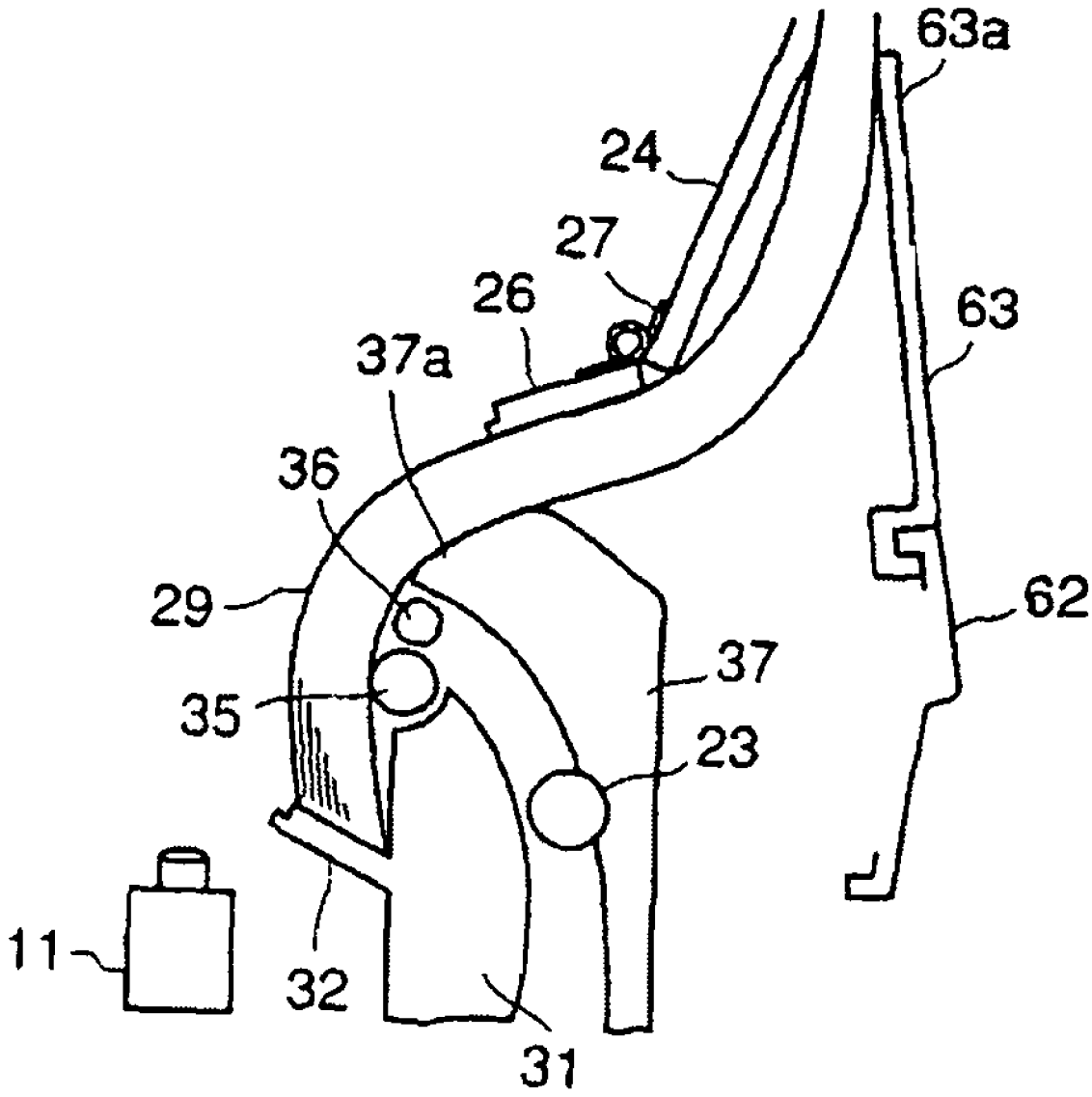
FIG. 10 is an operation illustration showing operation of the third embodiment.

Next, operation according to the third embodiment will be described with referring to FIG. 9 and FIG. 10. FIG. 9 and FIG. 10 are operation illustrations showing operation according to the third embodiment. As shown in FIG. 9, when the top cover is made open from a state that the top cover is closed, the stacked printing media enter in a standing state between the ejection roller 35 and the stacking portion 24 or the pivoting member 26. The medium receiving portion 63 pivotally moves in an opening direction as a distal end 63*a* is being in contact with the printing media 29.

Where the top cover 62 is opened at the maximum angle, the top cover 62 is prevented from pivotally moving further. This state is shown in FIG. 10. At this point, the printing medium 29 is held upon reception of the strongest pressing force exerted between the end 37*a* of the ejection guide 37 and the pivoting member 26, but an upper portion of the printing medium 29 may fall down to the opposite side of the stacking portion 24 if the printing medium 29 is long or has a lower rigidity. The medium receiving portion 63 is, however, arranged on the opposite side of the stacking portion 24, so that the printing media 29 otherwise falling down are received and surely held.

Generally, in a case where the printing media are discharged, a thin and less rigid medium may not be stacked on a stacking portion because a front end thereof is curled in a downward direction and rolled immediately below the ejection roller immediately after the medium is discharged from the ejection roller. To prevent this problem from occurring, the printing media are deliberately stacked on the stacking portion by directing the discharging direction of the printing medium upward or by curling vertically the printing media coming out of the ejection roller upon forming a high rib on the ejection guide.

In this embodiment, the cutout portion 64 is formed at a center portion on the end side of the medium receiving portion 63. Although discharged between the ejection roller 35 and the pressure roller 36, the printing media 29 are discharged in directing obliquely upward. Therefore, the end of the discharged printing media 29 hits the medium receiving portion 63. At that time the center portion in the width direction of the printing medium 29 enters in the cutout portion 64, and the media 29 are discharged as each of the side portions thereof contacts with the medium receiving portion 63. The printing media 29 are bent in a vertical direction in a shape that the center portion of the media is lifted up, and the media 29 are stacked on the stacking portion 24 with this state. That is, the printing media 29 can be bent in the vertical direction by forming the cutout portion 64, so that even long media or less rigid media can be discharged stably.

Where short printing media are discharged, the printing media can be taken out by putting a hand through the cutout portion 64. Formation of the medium receiving portion 63 can hide the ribs, the rollers, and the like located at a portion that the printing media 29 are discharged, so that the apparatus does have a good appearance. The shape of the cutout portion 64 is not limited to the shape shown in the drawings but is designed to be shaped easily forming bending according to, e.g., the size of the handled medium.

According to the third embodiment as described above, in addition to the advantage brought by the first embodiment, the apparatus can stably hold the printing media 29 where the top cover 62 is opened while the printing media 29 are stacked.

Figure 11:
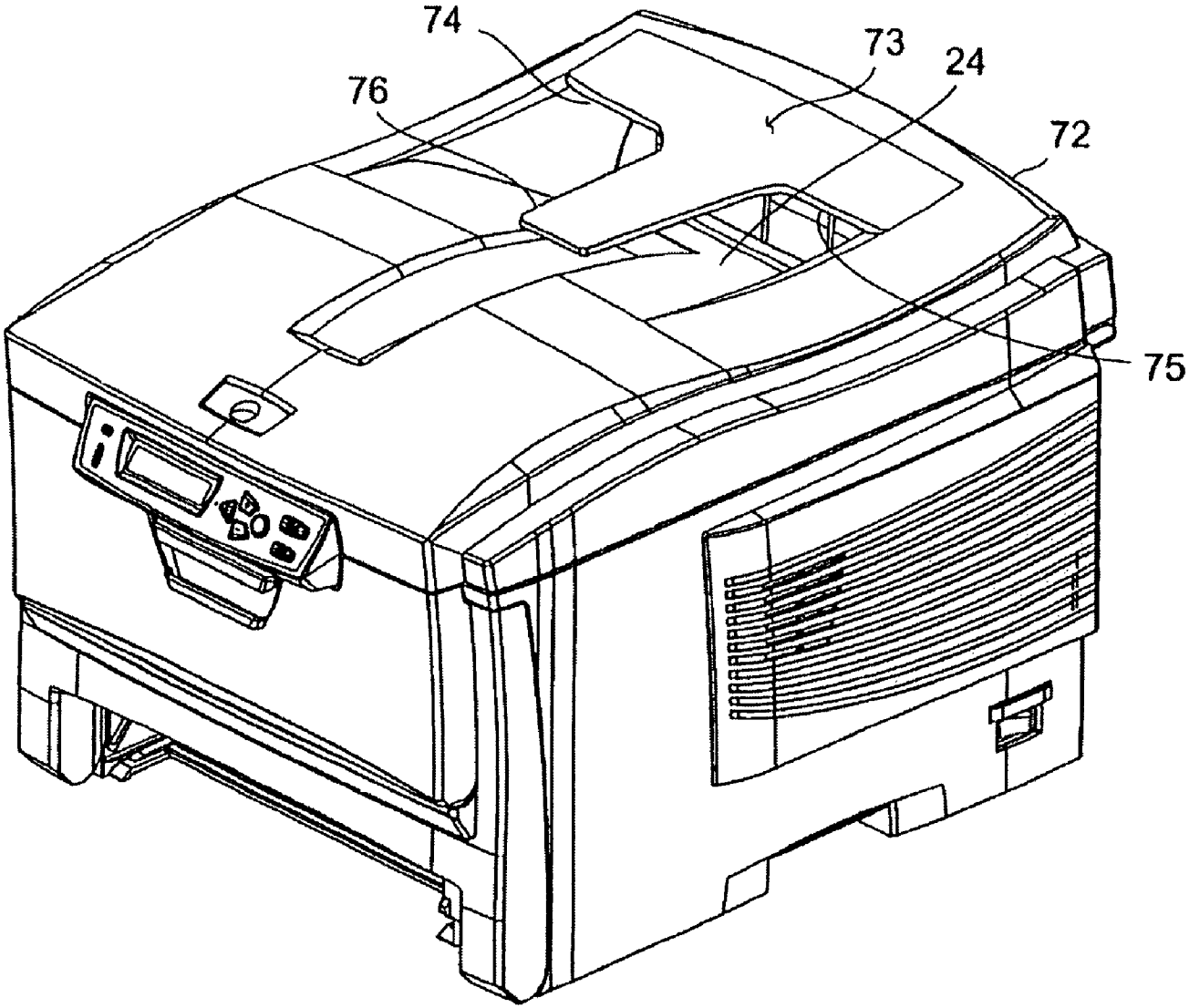
FIG. 11 is an external view showing a modification of the third embodiment.
Figure 12:
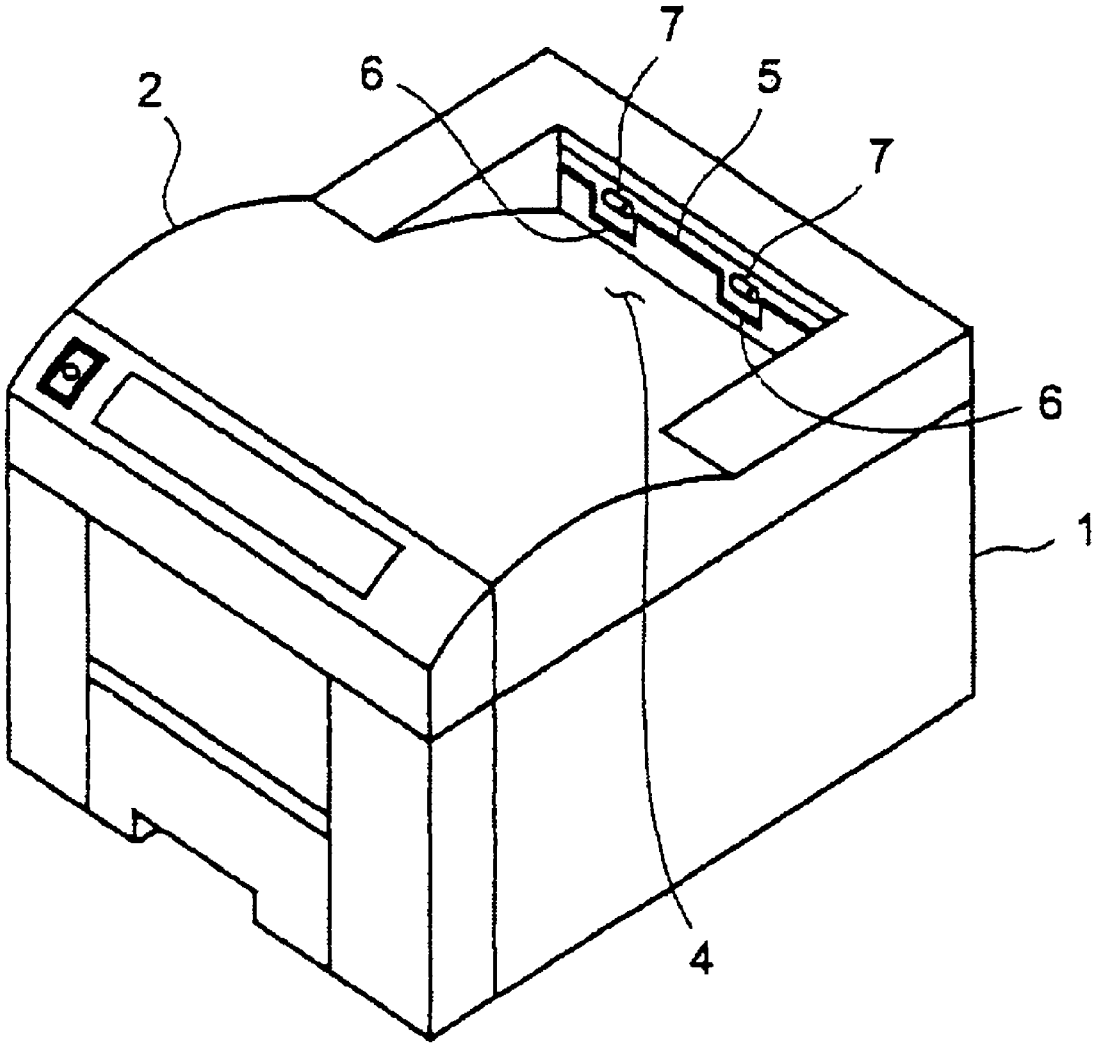
FIG. 12 is an external view showing a conventional printing apparatus.
Figure 13:
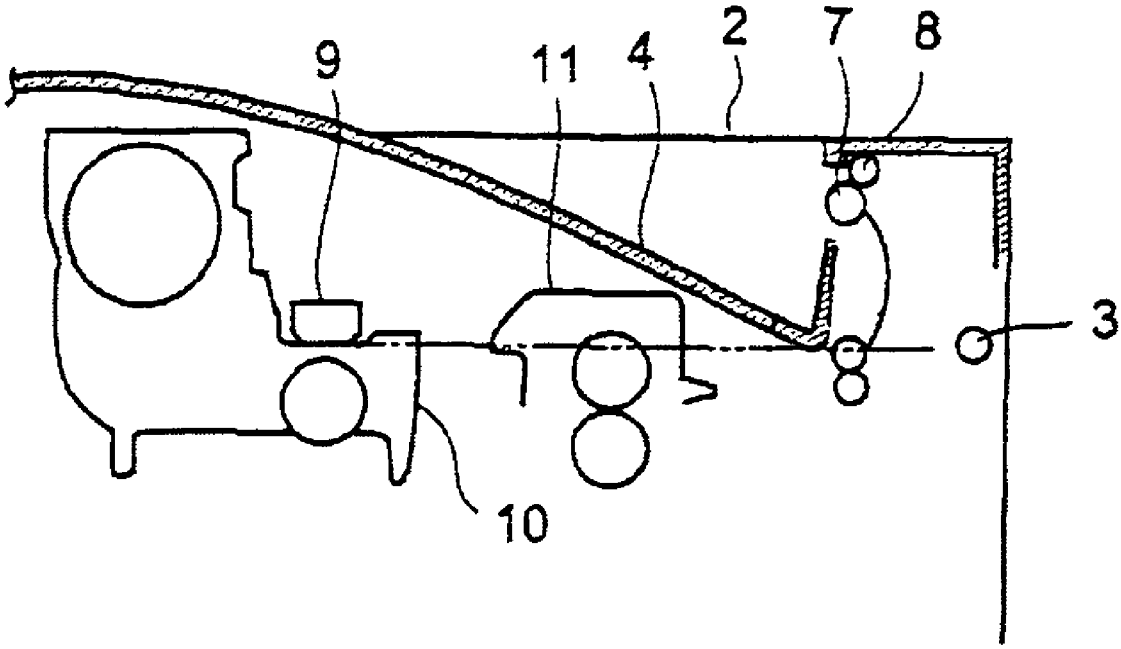
FIG. 13 PRIOR ART
FIG. 13 is a schematic side view showing an inside of the conventional printing apparatus.
Figure 14:
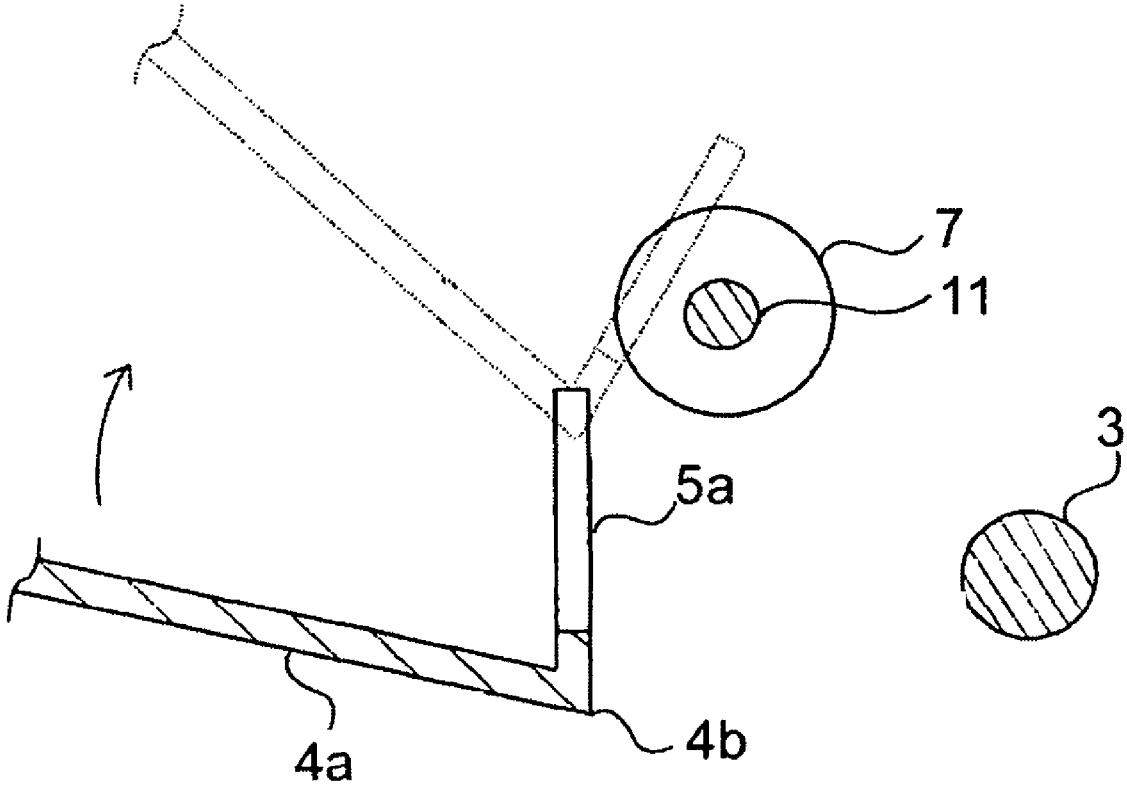
FIG. 14 is an operation illustration in a case that an end of a stacking portion is comparatively shallowly formed.
Figure 15:
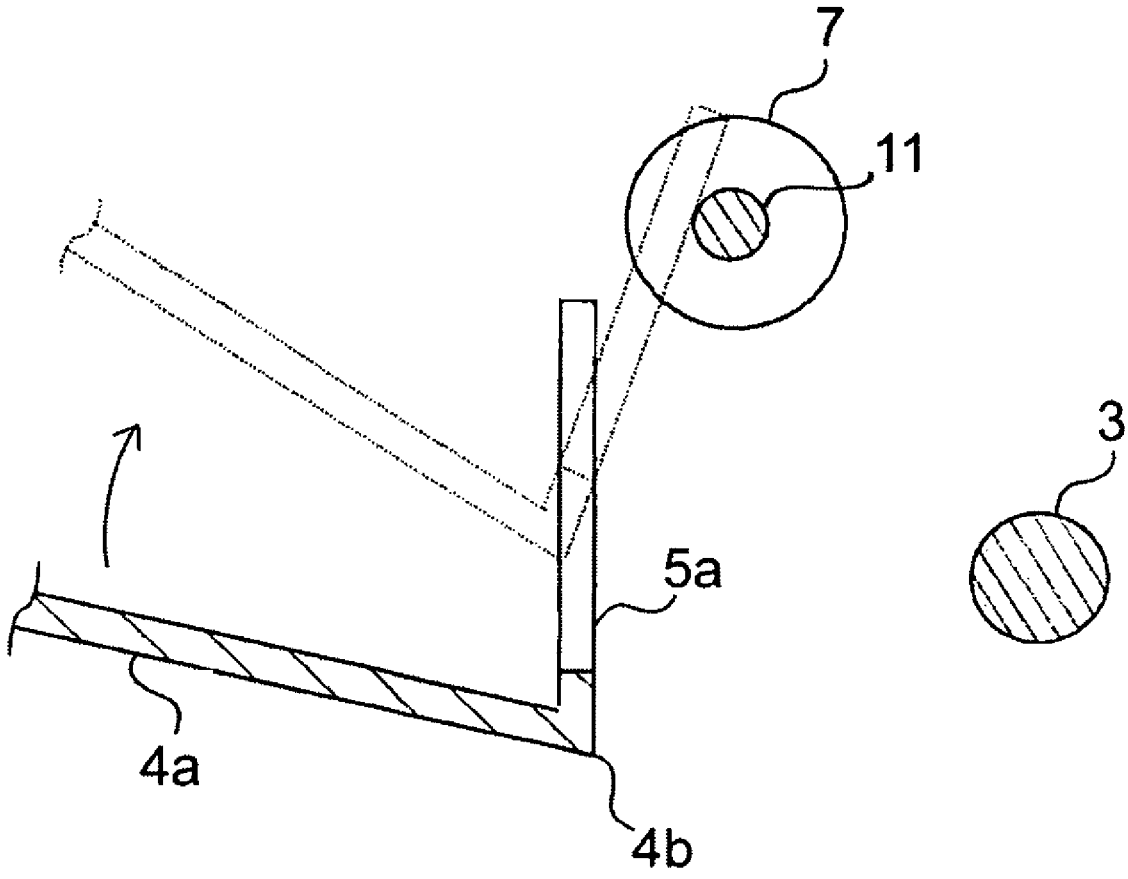
FIG. 15 is an operation illustration in a case that an end of a stacking portion is deeply formed.

Next, a modified example of the third embodiment will be described. FIG. 11 is an external view showing the modified example of the third embodiment. In this modified example, similarly to the third embodiment, a medium receiving portion 73 is formed at a top cover 72, but a shape thereof is different form the shape in the third embodiment. That is, the cutout portions 74, 75 are formed at respective side portions on the side of the distal end of the medium receiving portion 73, and a holding portion 76 is formed at the center. The medium receiving portion 73 has a function, substantially the same as in the third embodiment, to hold the printing media when the top cover 72 is opened while the printing media are stacked.

With formation of the pivoting member 73 in such a shape, the printing media can also be bent in the vertical direction. That is, when the printing medium is discharged, the end of the medium hits a lower side of the medium receiving portion 73. Because the opposite sides in the width direction of the printing medium are formed of the cutout portions 74, 75, the opposite sides of the printing medium enter in the cutout portions 74, 75. The center portion of the printing medium is discharged as being in contact with the holding portion 76. This mechanism allows the printing media to be bent in the vertical direction in a shape that the center portion of the printing medium is pressed and that opposite side portions of the medium are lifted up, and the printing media are stacked on the stacking portion 24. With this modified example, the apparatus can have substantially the same advantages as in the third embodiment.

Although in the respective embodiments described above the medium stacker apparatuses are explained in exemplifying the printing apparatus, this invention is not limited to those, and is applicable to any other apparatuses as far as having a structure that the top cover is openable and that a medium can be delivered to the top of the cover.

As described above in detail, according to this invention, because the second stacking portion, on which the media discharged from the delivery section are stacked, pivotally moves as separating from the first stacking portion formed at the apparatus housing, the second stacking portion is pivotally movable even where the media in a large number are stacked on the second stacking portion.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A medium stacker apparatus comprising:

a stacking portion having a first stacking portion and a second stacking portion, initially arranged adjacent to each other so that a surface of the first stacking portion is connected with a surface of the second stacking portion, the surface of the first stacking portion being in linear alignment with the surface of the second stacking portion, for stacking a medium discharged from a delivery section formed at an upper portion of an apparatus housing, the stacking portion comprising:

the first stacking portion secured to the apparatus housing; and the second stacking portion arranged to be pivotally movable separately from the first stacking portion to above the first stacking portion, a pivotal center of the second stacking portion arranged at a same side thereof as the delivery section with respect to the first stacking portion in a medium discharging path, when seen from the second stacking portion; and a top cover surface arranged above the delivery section;

wherein the first stacking portion is formed in proximity to the delivery section, between the second stacking portion and the pivotal center of the second stacking portion;

wherein the delivery section is arranged within a circle defined by rotation of the second stacking portion about the pivotal center of the second stacking portion;

wherein the second stacking portion is pivotally movable to a vertical position to press the medium against the top cover surface; and wherein the second stacking portion comprises an escaping portion at an end thereof adjacent to the first stacking portion, the escaping portion being configured to rotate to escape from a medium stacking surface of the second stacking portion in a direction opposite to a direction in which the second stacking portion pivotally moves separately from the first stacking portion.

2. The medium stacker apparatus according to claim 1, further comprising an urging means for urging the escaping portion in a direction toward the medium stacking surface.

3. The medium stacker apparatus according to claim 1, further comprising a cover member arranged so as to cover the first and second stacking portions.

4. The medium stacker apparatus according to claim 1, wherein the second stacking portion pivotally moves separately from the first stacking portion, the second stacking portion passes above the first stacking portion and further moves to above the delivery section, and the escaping portion escapes by coming in contact with an upper portion of the delivery section.

5. A medium stacker apparatus comprising:

a stacking portion having a first stacking portion and a second stacking portion, initially arranged adjacent to each other so that a surface of the first stacking portion is connected with a surface of the second stacking portion, the surface of the first stacking portion being in linear alignment with the surface of the second stacking portion, for stacking sheets of a medium discharged from a delivery section, the stacking portion comprising:

the first stacking portion fixed with respect to a housing of the medium stacker apparatus;

the second stacking portion arranged to be movable with respect to the first stacking portion, the second stacking portion comprising a non-escaping portion and an escaping portion, the escaping portion being arranged to be movable with respect to the non-escaping portion; and an abutment portion arranged above the delivery section, wherein where the second stacking portion moves separately from the first stacking portion, the escaping portion is configured to hold the stacked sheets of the medium against the abutment portion.

6. The medium stacker apparatus according to claim 5, wherein where the second stacking portion pivotally moves separately from the first stacking portion, the escaping portion holds the stacked medium against the abutment portion of the medium stacker apparatus and pivotally moves in a direction opposite to the pivotal movement of the second stacking portion in accordance with a pressure applied by the abutment portion.

* * * * *